US011577305B2

(12) United States Patent
Anderson et al.

(10) Patent No.: US 11,577,305 B2
(45) Date of Patent: Feb. 14, 2023

(54) SYSTEM, APPARATUS, AND METHOD FOR DIRECT CHILL CASTING VENTING

(71) Applicant: Wagstaff, Inc., Spokane Valley, WA (US)

(72) Inventors: Michael Kim Anderson, Otis Orchards, WA (US); Ryan Anthony Faulkner, Spokane Valley, WA (US); Gary Patrick Grealy, Liberty Lake, WA (US); David Alan Salee, Spokane, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

(21) Appl. No.: 17/446,704

(22) Filed: Sep. 1, 2021

(65) Prior Publication Data

US 2022/0062973 A1 Mar. 3, 2022

Related U.S. Application Data

(60) Provisional application No. 63/073,523, filed on Sep. 2, 2020.

(51) Int. Cl.

| | |
|---|---|
| ***B22C 9/06*** | (2006.01) |
| ***B22D 11/049*** | (2006.01) |
| *B22D 11/00* | (2006.01) |

(52) U.S. Cl.
CPC ..... *B22C 9/067* (2013.01); *B22D 11/049* (2013.01); *B22D 11/003* (2013.01)

(58) Field of Classification Search
CPC ..... B22C 9/067; B22D 11/049; B22D 11/003; B22D 11/07; B22D 11/11; B22D 11/055; B22D 11/124
See application file for complete search history.

(56) References Cited

U.S. PATENT DOCUMENTS

2012/0241118 A1 9/2012 Wagstaff et al.

FOREIGN PATENT DOCUMENTS

EP 3117931 A1 1/2017
WO WO-2019038551 A1 * 2/2019 ..... B22D 11/0401

OTHER PUBLICATIONS

International Search Report and Written Opinion for PCT/US2021/048200 (ISA/EP) dated Nov. 15, 2021 (16 pages).
Meethum et al., *Evaluate of chill Vent Performance for High Pressure Die-Casting production and Simulation of Motorcycle Fuel Caps*, Matec Web of Conferences, vol. 95, Jan. 1, 2017, 07025.

* cited by examiner

*Primary Examiner* — Kevin P Kerns
*Assistant Examiner* — Steven S Ha
(74) *Attorney, Agent, or Firm* — Alston & Bird LLP

(57) ABSTRACT

Provided herein is a system, apparatus, and method for venting a direct chill casting mold by venting excess casting gas and retaining oxide from atop a casting during the direct chill casting process. Methods of venting casting gas from a direct chill casting mold include: supplying the direct chill casting mold with molten metal through a transition plate; supplying a casting gas through a casting surface of the direct chill casting mold; venting the casting gas from a gas pocket in the transition plate, wherein venting the casting gas from the gas pocket in the transition plate is performed in response to a pressure of the casting gas in the gas pocket reaching a predetermined pressure.

19 Claims, 9 Drawing Sheets

SYSTEM, APPARATUS, AND METHOD FOR DIRECT CHILL CASTING VENTING

CROSS-REFERENCE TO RELATED APPLICATIONS

This application claims priority to U.S. Provisional Patent Application Ser. No. 63/073,523, filed on Sep. 2, 2020, the contents of which are hereby incorporated by reference in their entirety.

TECHNOLOGICAL FIELD

The present disclosure relates to a system, apparatus, and method for venting a direct chill casting mold, and more particularly, to venting excess casting gas and retaining oxide from atop a casting during the direct chill casting process.

BACKGROUND

Metal products are formed in a variety of ways; however numerous forming methods first require an ingot, billet, or other cast part that can serve as the raw material from which a metal end product can be manufactured, such as through rolling, extrusion, or machining, for example. One method of manufacturing an ingot or billet is through a continuous casting process known as direct chill casting, whereby a vertically oriented mold cavity is situated above a platform that translates vertically down into a casting pit. A starter block may be situated on the platform and form a bottom of the mold cavity, at least initially, to begin the casting process. Molten metal is poured into the mold cavity whereupon the molten metal cools, typically using a cooling fluid. The platform with the starter block thereon descends into the casting pit at a predefined speed to allow the metal exiting the mold cavity and descending with the starter block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

BRIEF SUMMARY

The present disclosure relates to a system, apparatus, and method for venting a direct chill gas cushion casting hot-top billet mold, and more particularly, to venting excess casting gas and retaining oxide from atop a casting during the direct chill casting process. Embodiments provided herein include a transition plate for a direct chill casting mold including: a top surface, a bottom surface, where a casting gas pocket is defined at a periphery of the bottom surface, and one or more vent holes defined within the casting gas pocket. The transition plate of an example embodiment includes a lip that extends around the periphery of the transition plate and is separated from the bottom surface by a gas pocket surface. The one or more vent holes of an example embodiment are defined in the gas pocket surface.

According to an example embodiment of the transition plate, the lip is elevated with respect to the bottom surface when the transition plate is positioned on a mold, where the casting gas pocket is formed at the periphery of the transition plate by the lip and the gas pocket surface, where the vent holes are disposed closer to the bottom surface than to the lip. According to an example embodiment, in response to a gas bubble forming in the casting gas pocket, the plurality of vent holes are configured to permit casting gas to be vented before the casting gas reaches the bottom surface of the transition plate. The gas pocket surface of an example embodiment includes a chamfered surface relative to the bottom surface, where the one or more vent holes are defined in the chamfered surface. The plurality of vent holes of an example embodiment include a web of material that is gas permeable and not permeable by molten metal. The plurality of vent holes of an example embodiment are vented to atmospheric pressure. The plurality of vent holes of an example embodiment are associated with a valve, where the valve permits the plurality of vent holes to be vented to atmospheric pressure in response to pressure in the casting gas pocket satisfying a predetermined value. According to an example embodiment, the transition plate includes a lip, where the casting gas pocket is defined between the lip and the bottom surface.

Embodiments provided herein include a method of venting casting gas from a direct chill casting mold including: supplying the direct chill casting mold with molten metal through a transition plate; supplying a casting gas through a casting surface of the direct chill casting mold; and venting the casting gas from a gas pocket in the transition plate, where venting the casting gas from the gas pocket in the transition plate is performed in response to a pressure of the casting gas in the gas pocket reaching a predetermined pressure. The predetermined pressure of an example embodiment is determined based on a metallostatic head pressure of the molten metal supplied to the direct chill casting mold. The method of an example embodiment further includes: supplying pressure to a plurality of vent holes in the transition plate to prevent molten metal flow through the vent holes; and reducing or removing pressure to the plurality of vent holes to allow venting of casting gas.

Embodiments provided herein include a system for venting a direct chill casting mold including: a direct chill casting mold; a thimble through which molten metal is supplied to the direct chill casting mold; a transition plate attached to the direct chill casting mold and into which the thimble is received, where the transition plate includes a gas channel and a plurality of vents disposed therein, where in response to molten metal filling the direct chill casting mold, casting gas is vented through the gas channel in the transition plate. The transition plate of an example embodiment includes a top surface and a bottom surface, where the casting gas pocket is defined at a periphery of the bottom surface.

According to a system of an example embodiment, the transition plate includes a lip, where the lip extends around the periphery of the transition plate and is separated from the bottom surface by a gas pocket surface. The one or more vent holes of an example embodiment are defined in the gas pocket surface. The lip of a transition plate of an example embodiment is elevated with respect to the bottom surface when the transition plate is positioned on a mold, where the casting gas pocket is formed at the periphery of the transition plate by the lip and the gas pocket surface, and where the vent holes are disposed closer to the bottom surface than to the lip. According to an example embodiment, in response to a gas bubble forming the int e casting gas pocket, the plurality of vent holes are configured to permit casting gas to be vented before the casting gas reaches the bottom surface of the transition plate. The gas pocket surface of an example embodiment includes a chamfered surface relative to the bottom surface, where the one or more vent holes are defined in the chamfered surface.

BRIEF DESCRIPTION OF THE DRAWINGS

Figure 1:
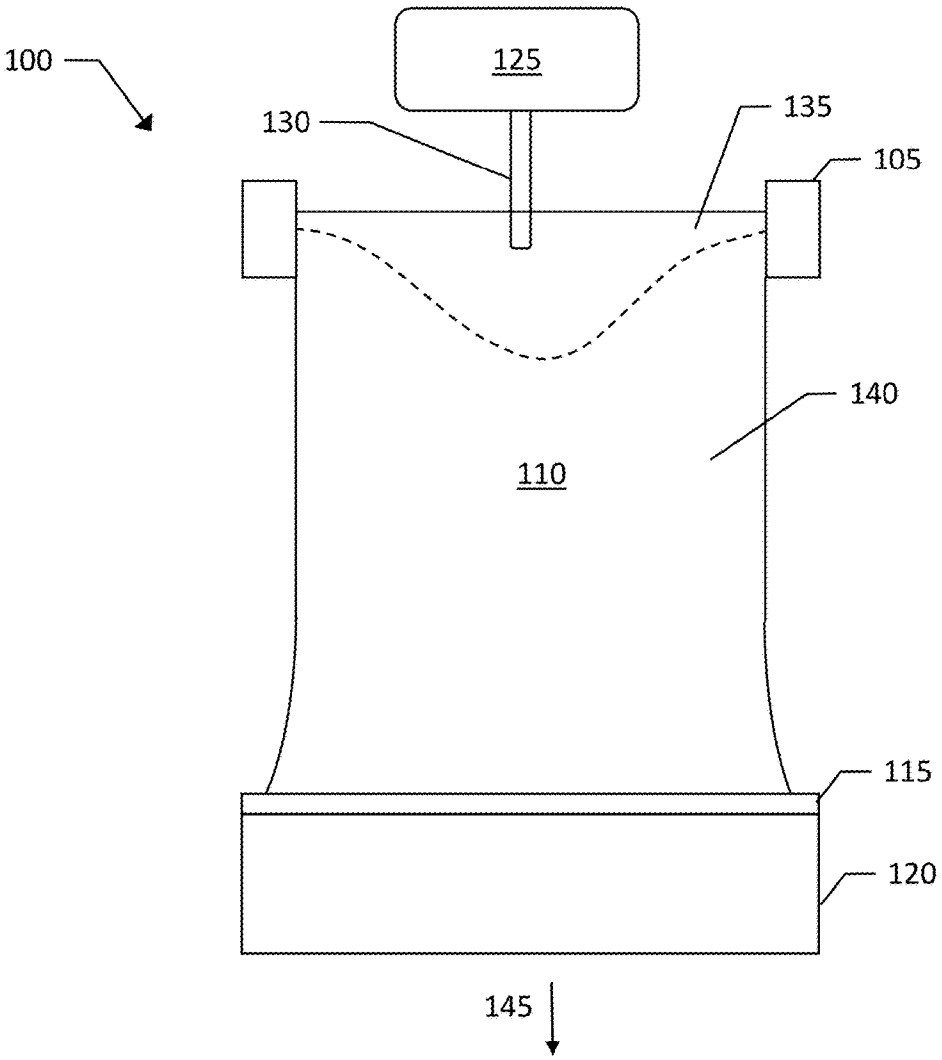
FIG. 1 (PRIOR ART)
Figure 2:
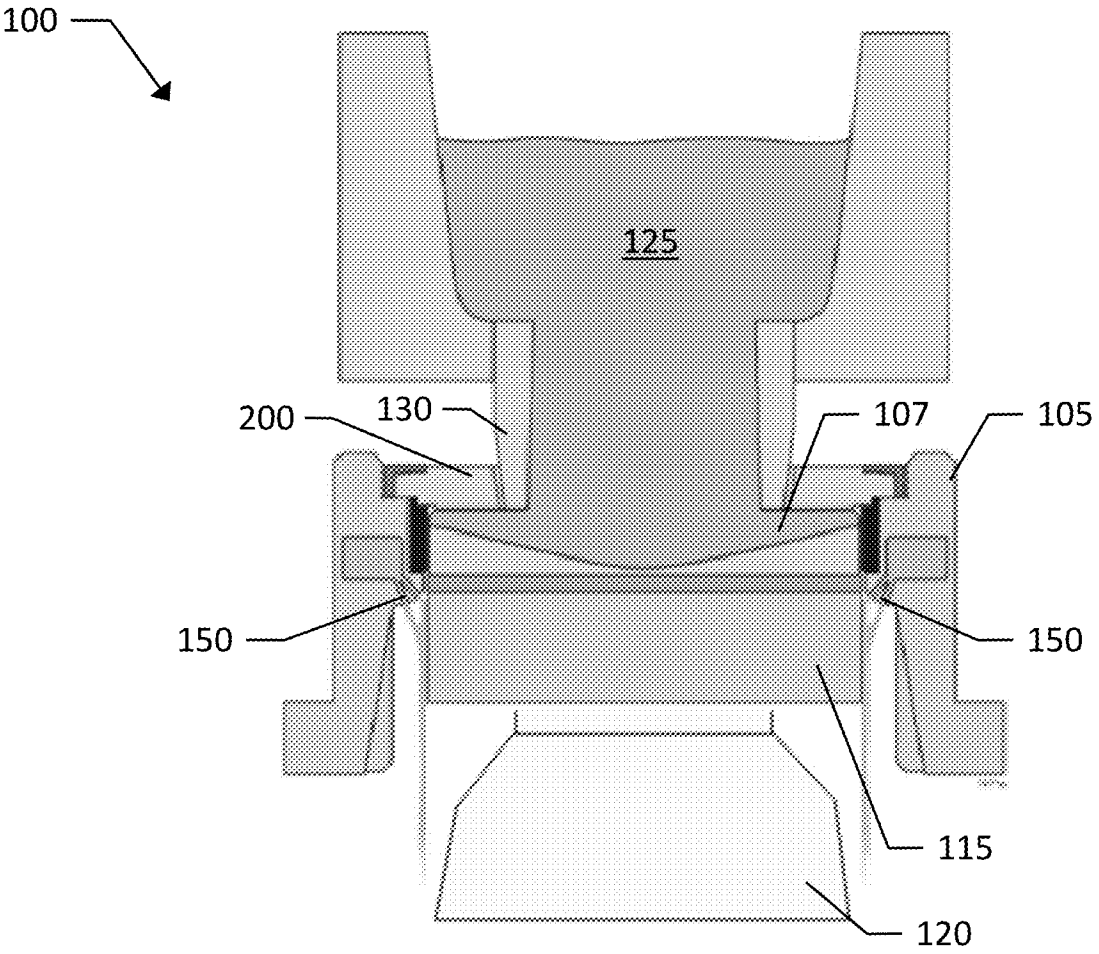
Figure 3:
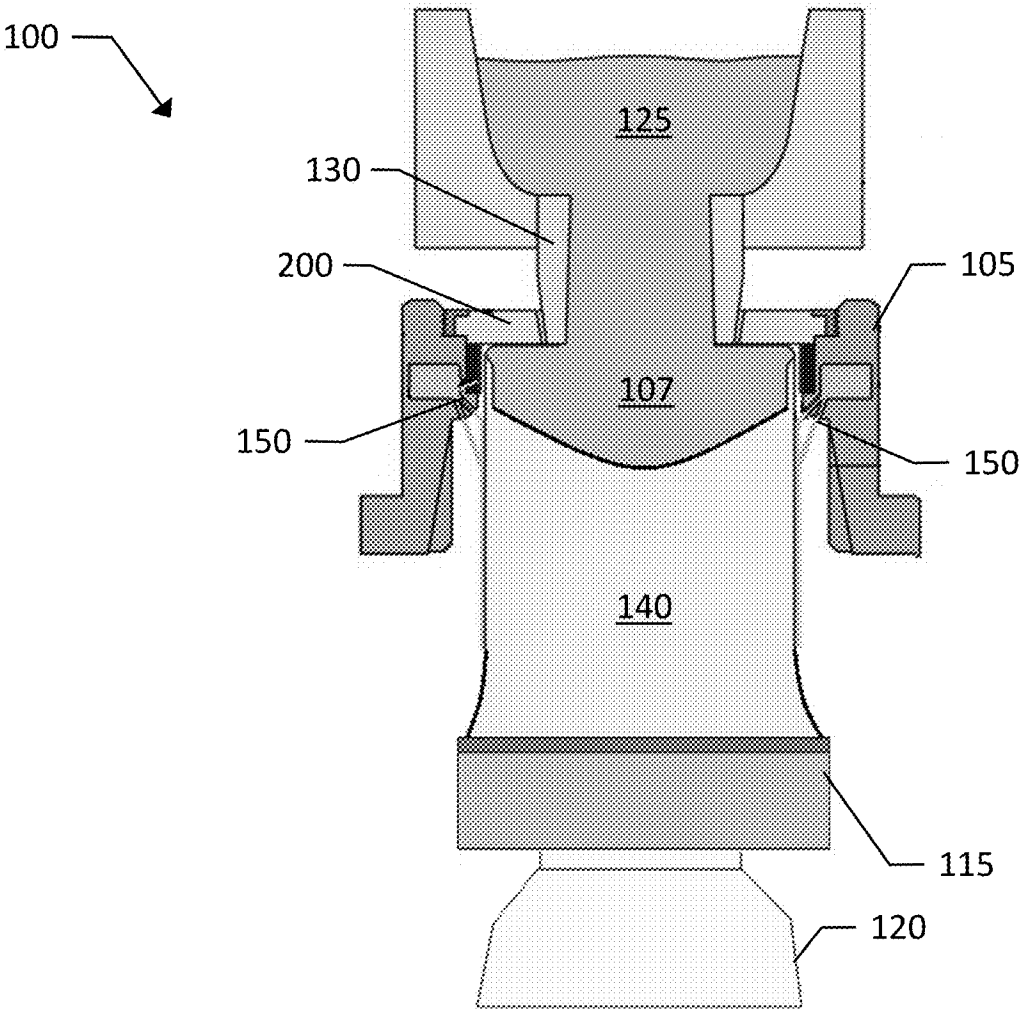
Figure 4:
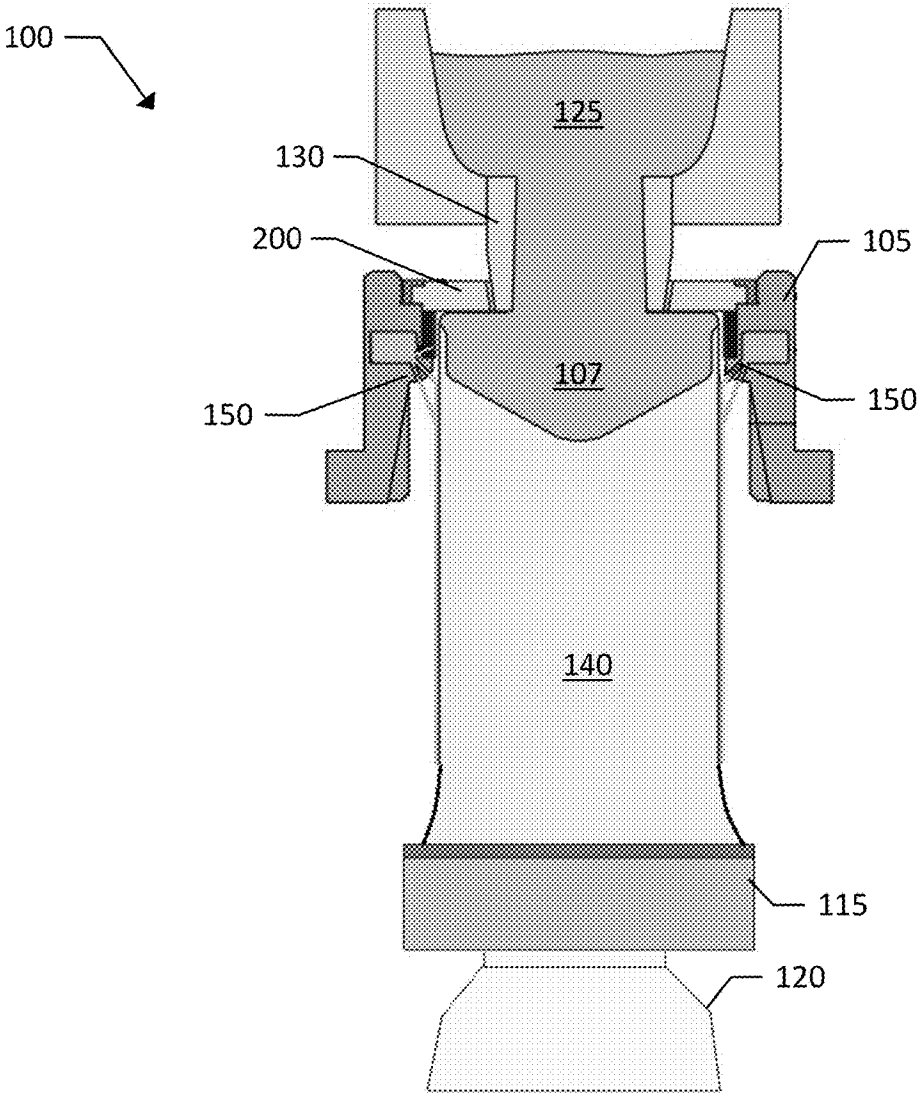
Figure 5:
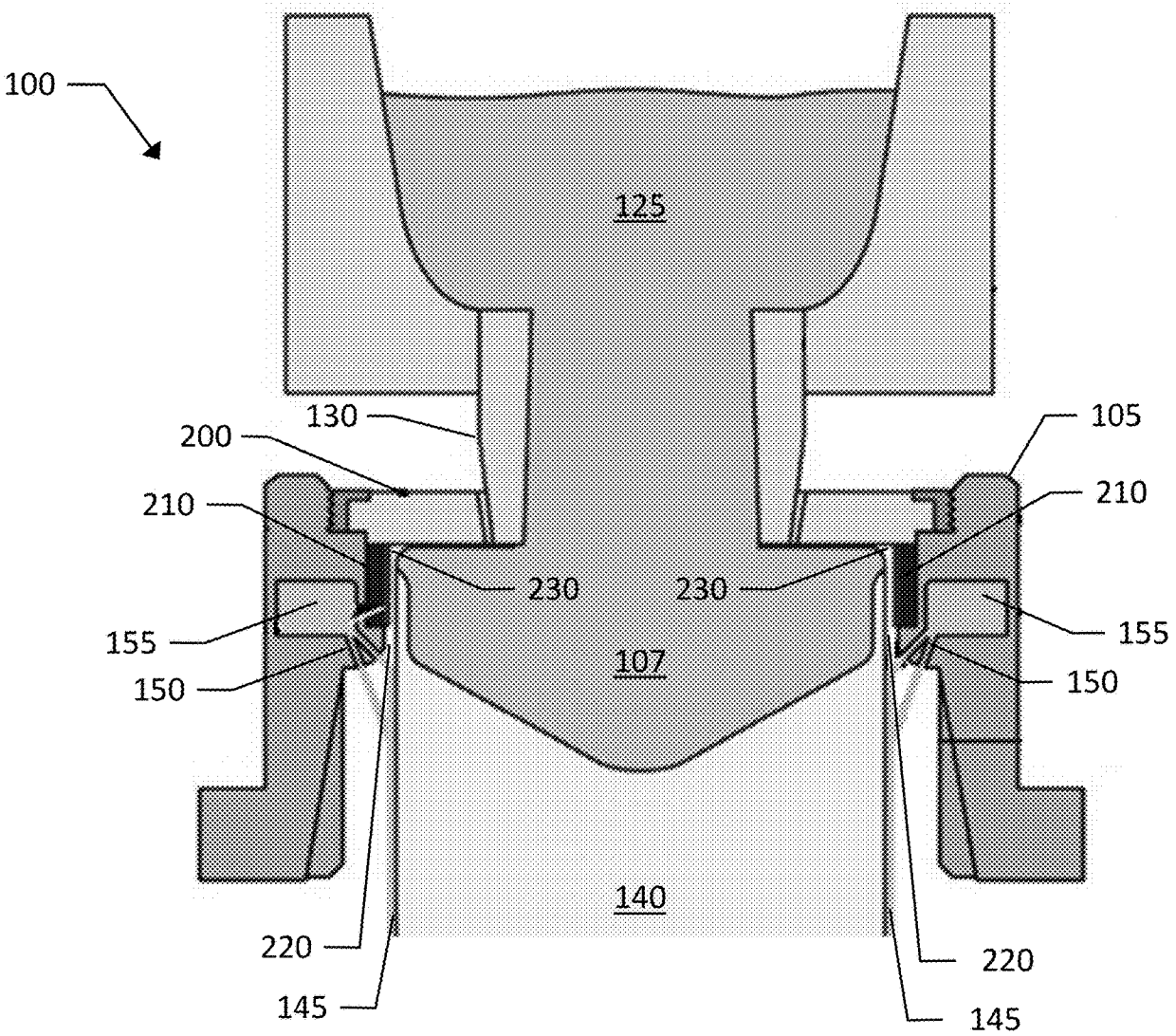
Figure 6:
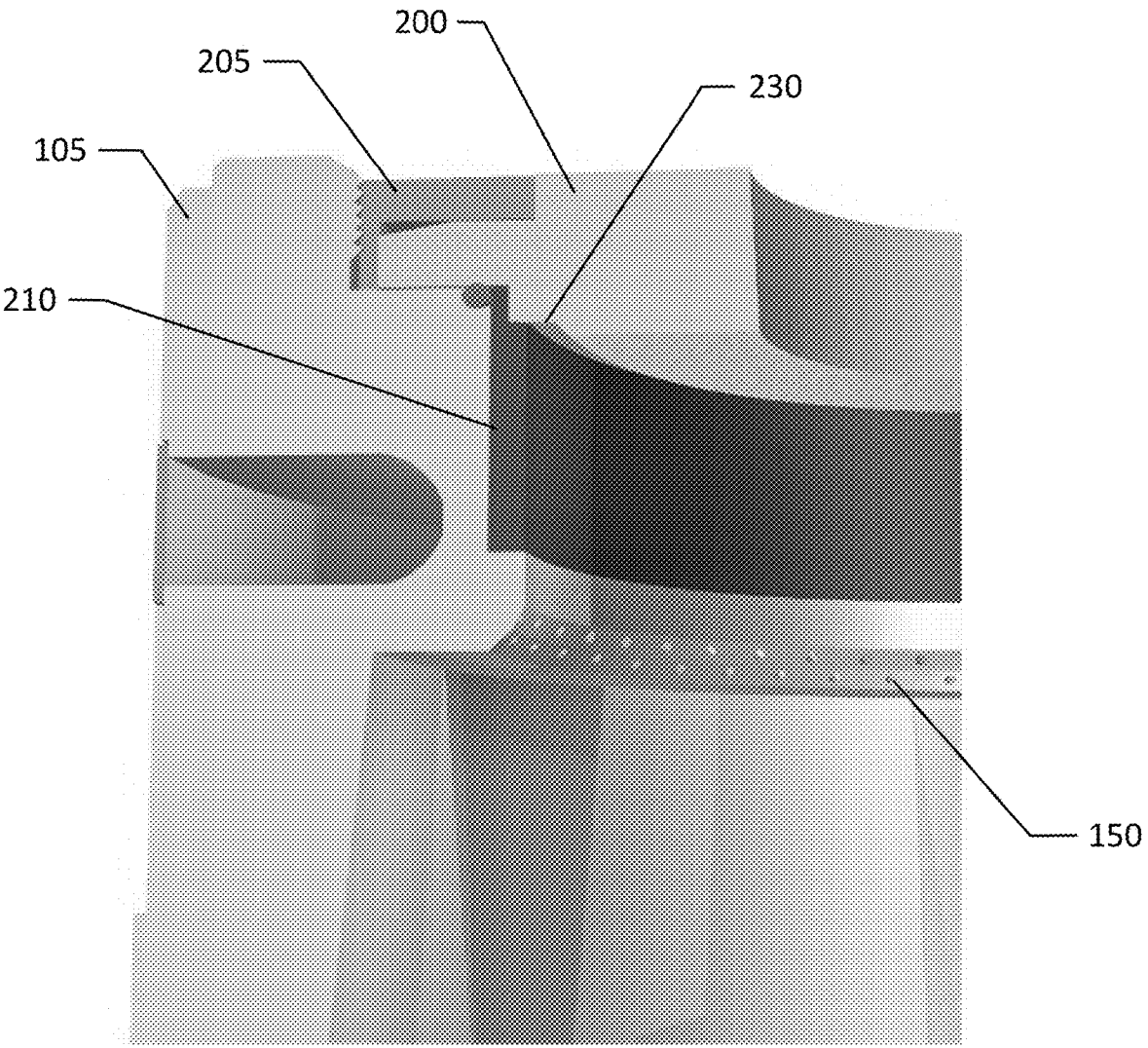
Figure 7:
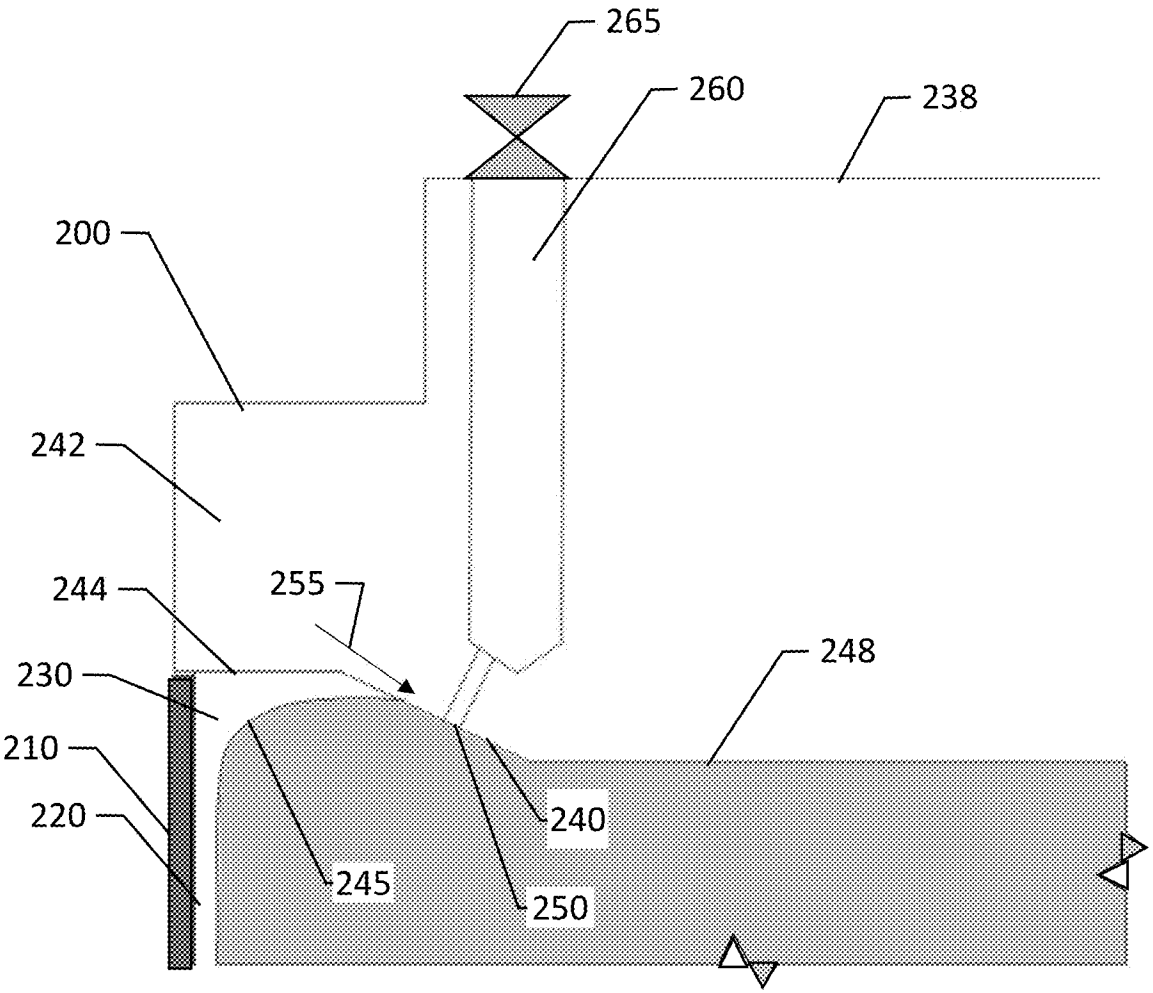
Figure 8:
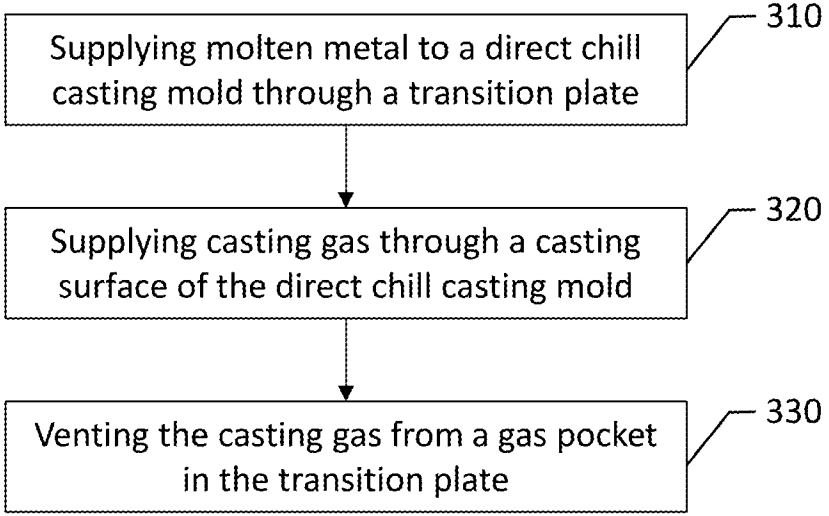
Figure 9:
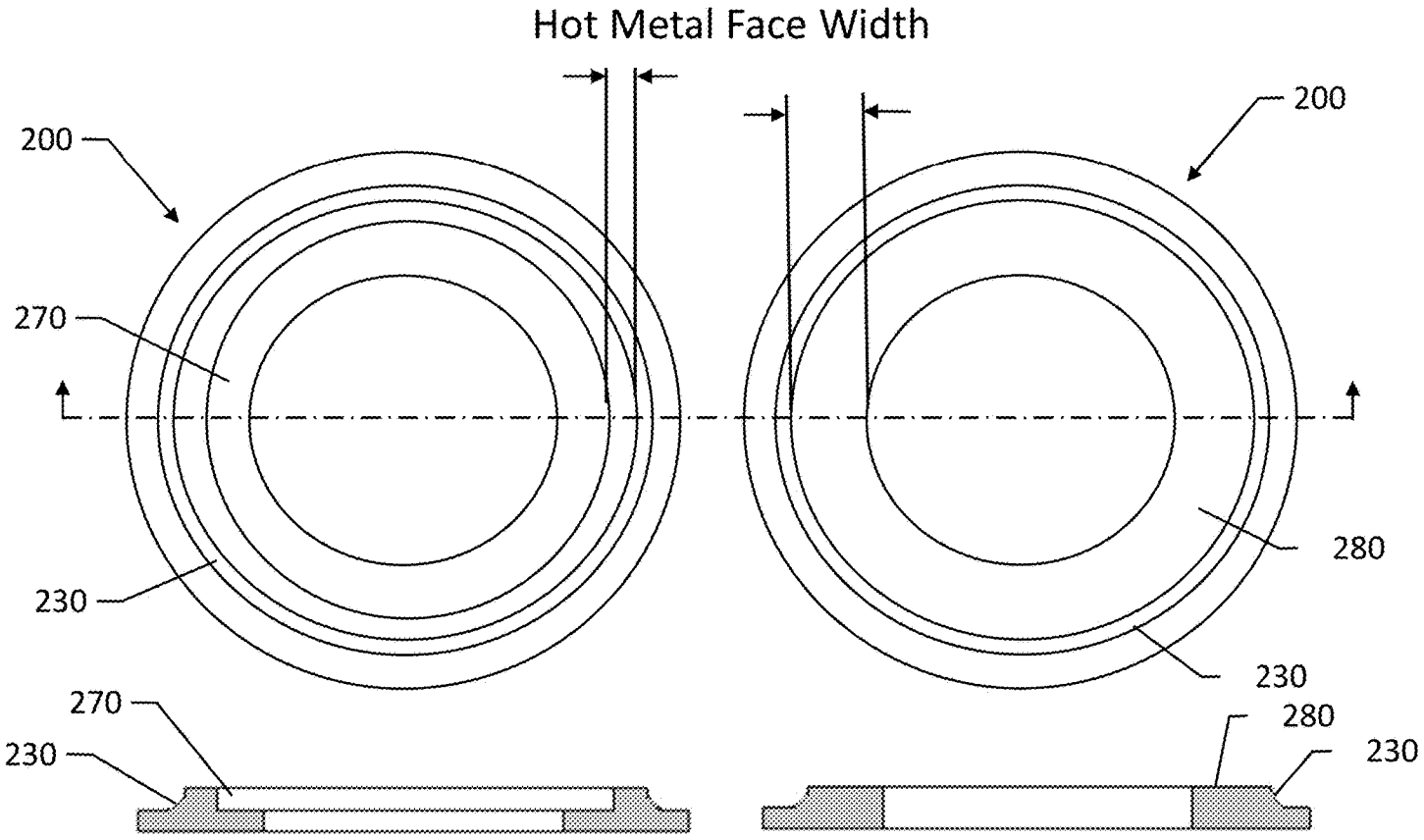

Having thus described the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an example of the initial stages of direct chill casting or continuous casting according to an example embodiment of the present disclosure;

FIG. 3 illustrates an example embodiment following the initial stages of direct chill casting according to an example embodiment of the present disclosure;

FIG. 4 illustrates an example embodiment of steady-state direct chill casting according to an example embodiment of the present disclosure;

FIG. 5 illustrates air gap casting of a billet according to an example embodiment of the present disclosure;

FIG. 6 illustrates the casting gas pocket configuration in a transition plate according to an example embodiment of the present disclosure;

FIG. 7 illustrates vent holes defined within a casting gas pocket according to an example embodiment of the present disclosure;

FIG. 8 is a flowchart of a method for venting casting gas from a direct chill casting mold according to an example embodiment of the present disclosure; and FIG. 9 illustrates a transition plate including an oxide dam according to an example embodiment of the present disclosure.

DETAILED DESCRIPTION

Example embodiments of the present disclosure now will be described more fully hereinafter with reference to the accompanying drawings, in which some, but not all embodiments of the disclosure are shown. Indeed, embodiments described herein take many different forms and should not be construed as limited to the embodiments set forth herein; rather, these embodiments are provided so that this disclosure will satisfy applicable legal requirements. Like numbers refer to like elements throughout.

Embodiments of the present disclosure generally relate to a system, apparatus, and method for venting a direct chill casting mold, and more particularly, to venting excess casting gas and retaining oxide from atop a casting during the direct chill casting process.

Vertical direct chill casting or continuous casting is a process used to produce ingots or billets that have a variety of cross-sectional shapes and sizes for use in a variety of manufacturing applications. The process of direct chill casting begins with a horizontal mold table or mold frame containing one or more vertically-oriented molds disposed therein. Each of the molds defines a mold cavity, where the mold cavities are initially closed at the bottom with a starter block to seal the bottom of the mold cavity. Molten metal is introduced to each mold cavity through a metal distribution system to fill the mold cavities. As the molten metal proximate the bottom of the mold, adjacent to the starter block solidifies, the starter block is moved vertically downward along a linear path into a casting pit. The movement of the starter block is caused by a hydraulically-lowered platform to which the starter block is attached. The movement of the starter block vertically downward draws the solidified metal from the mold cavity while additional molten metal is introduced into the mold cavity. Once started, this process moves at a relatively steady-state for a continuous casting process that forms a metal ingot having a profile defined by the mold cavity, and a height defined by the depth to which the platform and starter block are moved.

During the casting process, the mold itself is cooled to encourage solidification of the metal prior to the metal exiting the mold cavity as the starter block is advanced downwardly, and a cooling fluid is introduced to the surface of the metal proximate the exit of the mold cavity as the metal is cast to draw heat from the cast metal ingot and to solidify the molten metal within the now-solidified shell of the ingot. As the starter block is advanced downward, the cooling fluid is sprayed directly on the ingot to cool the surface and to draw heat from within the core of the ingot.

FIG. 1 depicts a general illustration of a cross-section of a direct chill casting mold 100 during the continuous casting process. The illustrated mold could be for a round billet or a substantially rectangular ingot, for example. The cooling water spray pattern as described herein is primarily directed to round billet casting. However, embodiments could potentially be used for a substantially rectangular ingot, particularly when the corners of said ingot have some degree of curvature. As shown, the continuous casting mold 105 forms a mold cavity from which the cast part 110 is formed. The casting process begins with the starter block 115 sealing or substantially filling the bottom of the mold cavity against mold walls of the continuous casting mold 105. As the platform 120 moves down along arrow 145 into a casting pit and the cast part begins to solidify at its edges within the mold walls of the continuous casting mold 105, the cast part 110 exits the mold cavity. Metal flows from a pouring trough 125, which in some embodiments includes a heated reservoir or a reservoir fed from a furnace, for example, through thimble 130 into the mold cavity. As shown, the thimble 130 is partially submerged within a molten pool of metal 135 to avoid the oxidation of metal that would occur if fed from above the molten metal pool 135. The solidified metal 140 constitutes the formed cast part, such as an ingot. Flow through the thimble 130 is controlled within the pouring trough 125, such as by a tapered plug fitting within an orifice connecting a cavity of the pouring trough 125 with a flow channel through the thimble 130. Conventionally, the pouring trough 125, thimble 130, and mold cavity/mold walls of the continuous casting mold 105 are held in a fixed relationship from the beginning of the casting operation through the end of the casting operation. Flow of metal through the thimble 130 continues as the platform 120 continues to descend along arrow 145 into the casting pit. When the casting operation is to end, either by the platform being at the bottom of its travel, the metal supply running low, or the cast part reaching the completed size, the flow of metal through the thimble 130 stops, and the thimble assembled on the trough is removed from the molten pool of metal 135 to allow the molten pool to solidify and complete the cast part.

FIG. 2 illustrates an example embodiment of a hot top casting method of the direct chill casting process according to the present disclosure including a continuous casting mold 105, trough 125, and thimble 130 for supplying molten metal from the trough to the cavity of the mold. The illustrated embodiment of FIG. 2 includes a starting position where the tip of the thimble 130 or thimble is positioned proximate the starter block 115 which is supported by the platform 120. The starter block 115 is positioned atop platform 120 and aligned to cooperate with the mold 105 to seal the mold cavity and preclude molten metal 107 from leaking from between the continuous casting mold 105 and the starter block 115. The thimble 130 or thimble is received into a transition plate 200 that is securely attached to the top of the mold 105, such as by threaded engagement. The transition plate 200 of an example embodiment is secured to the mold 105 by a metal ring that is threaded into a round opening atop the billet mold 105 to hold the transition plate securely to the mold. The mold 105 of an example embodiment is constructed of a metal such as aluminum, while the thimble 130 and transition plate 200 are generally formed of a refractory material that is resilient to heat.

FIG. 2 illustrates the start of a cast with the starter block 115 aligned with the continuous casting mold 105. As the cast starts shown in FIG. 3, the platform 120 descends with the starter block 115 as molten metal flows through the thimble 130 from the trough 125, and solidifies on the starter block 115 and at the bottom of the mold cavity forming the cast part 140. In this manner, as the starter block 115 descends away from the continuous casting mold 105, the cast part, shown in FIG. 4 as 140, is formed. FIG. 4 illustrates the run-state phase of the casting process or the steady-state portion where the platform 120 descends at a near constant rate with the cast part 140 growing accordingly. FIG. 2 also illustrates spray jets 150 that will be described in greater detail below, where the spray jets provide a coolant or cooling fluid to the surface of the casting.

Direct chill casting using the hot top casting method of FIGS. 2-4 with a transition plate 200, while effective, has drawbacks. In particular, excess casting gas and oxides become trapped between the surface of the molten metal 107 and the transition plate 200.

According to example embodiments described herein, billet mold casting technology for hot-top direct chill casting of aluminum, as shown in FIG. 5, employs a graphite casting surface 210 upon which the initial solidification of the billet being cast occurs. The permeable graphite material allows for flowing both casting gas and casting lubricant to the casting surface that produces an air-slip casting condition including air gap 220 between the molten metal 107 that is solidifying in the mold cavity and the graphite casting surface 210. The casting lubricant reduces the friction on the casting surface 210 to prevent sticking and tearing of the freshly solidifying shell of the cast part 140. The casting gas flow further aids in reducing this friction while at the same time provides a thin film of gas between the casting surface and the billet shell which reduces the thermal heat transfer from the molten aluminum to the casting surface. When properly balanced, the introduction of gas and oil produces an as-cast billet with a very smooth surface and very narrow shell thickness as compared to conventionally cast billets. Water or coolant flowing to spray jets 150 from the coolant chamber 155 impinges upon the shell of the cast part 140 and proceeds to flow down the sides of the cast part as shown at 145 to further cool the casting.

The amount of casting lubricant used during casting is directly related to the surface area of the billet. Balancing the amount of casting gas introduced through the casting surface is difficult Due to the inherent shrinkage that occurs during the solidification process, the shell of the billet contracts away from the casting surface 210 slightly and allows the gas to escape out the lower portion of the mold cavity. However, the density of the casting gas is substantially lower than the molten metal, such that any excess casting gas that cannot escape out the lower portion of the mold tends to rise upwards inside the mold cavity and up through the molten metal above the mold in the pouring trough 125 or "hot top" design of the casting system. Further, an air trapping recess or pocket of an example embodiment is fabricated into the transition plate 200 or graphite casting ring forming the casting surface 210 which captures the gas in a pocket 230 at the corner of the mold cavity where the flowing liquid metal turns from a horizontal trajectory to a vertical trajectory, and down along the casting surface.

FIG. 6 illustrates a section-view of a portion of a mold 105 including the transition plate 200 secured to the mold by a threaded collar 205. Also shown is the graphite casting surface 210 and the pocket 230 at the corner that captures rising casting gas. When properly balanced, the continual flow of casting gas fills the pocket 230 and as the pressure increases to the point that the pressure matches the metallostatic pressure of the metal in the trough 125 above, the gas flows downward through the air gap 220 without bubbling up through the thimble 130. Bubbling up through the molten metal should be reduced or prevented in order to prevent entrainment of oxide films into the metal above the mold which are then pulled down into the solidifying billet. These oxide films are considered to be 'inclusions' which have the potential to create defects in subsequent downstream processed components.

The gas pocket 230 in a direct chill casting system described herein is the area where the transition plate 200 meets the casting surface 210. This area is where the molten aluminum flows outward from the metal feed opening in the thimble 130 toward the mold wall and then changes direction to flow downward to begin forming the solidifying shell. In a hot top casting configuration as shown in FIGS. 2-5, the metallostatic pressure of the liquid metal head above the mold attempts to force the metal to completely fill this area and forms the pocket 230 of gas, and the accumulated gas pressure combined with the alloy and strength of the oxide forms a critical radius commonly referred to as the 'meniscus' radius. To aid in the formation of the meniscus radius and contain the trapped gas, according to example embodiments described herein, a recess is fabricated into the transition plate at the casting surface interface.

The gas pocket 230 of example embodiments is designed such that the width is kept close to the natural meniscus radius formed. The depth of the pocket 230 of an example embodiment is kept to a minimum in order to reduce the overall volume of the pocket. The edge of the pocket 230 of an example embodiment is smoothed to reduce the tendency to tear the oxide layer as it moves along the hot metal face and transitions to the pocket and meniscus radius. During casting using the hot top method of direct chill casting described herein, a dynamic heaving or pulsing action forms at the pocket 230 area. The gas bubble in the pocket increases in size as does the pressure due to the continual influx of casting gas until the air bubble can force its way down between the mold wall and the casting along the air gap 220 and escape out of the bottom of the mold cavity. This increase in bubble volume forces metal back up through the thimble or thimble 130 such that when the gas pressure is released and gas escapes, the metal level lowers. A swaying or rocking harmonic may develop with the mold that is located directly across the metal delivery runner of the trough 125. This cyclical heaving of the meniscus should be reduced or kept to a minimum to prevent formation of surge laps, which are accompanied by a microstructural abnormality in the solidifying billet shell that is generally shown as meniscus marks. These meniscus marks directly affect the total shell zone width, and thicker shell zones are undesirable for downstream processing when too pronounced.

A secondary reason to reduce or to keep the metal heaving to a minimum is that as the gas bubble in the pocket 230 increases in size, the bubble extends beyond the edge of the pocket 230 onto the hot metal face adjacent to the transition plate 200. When excess casting gas releases along the air gap 220 and the bubble shrinks, the action splays the oxide layer across the edge of the pocket. As this occurs, the oxide layer often tears which can lead to metal attachments to the pocket edge along with random non-uniform oxide releases on the billet surface.

In a worst case scenario of example embodiments of hot top casting, the casting gas flow rate is too great for the natural release of gas down and out through the bottom of the mold cavity, and the excess gas breaks out over the edge of the thimble 130 opening and releases bubbles up through the melt above the mold. This sudden escape of gas violently collapses the gas pocket and liquid metal completely fills into the area. This event has several undesirable consequences leading to poor billet surface quality. For example, a result includes a large heavy oxide release creating a non-uniform billet surface appearance. There is increased potential for folding these heavy oxides that are subsurface into the solidifying shell, and increased potential for attachments to the transition plate pocket 230 area or the graphite casting surface 210 as the protective oxide layer has been breached and liquid metal contacts these surfaces. The collapse of the meniscus and exposure to liquid metal increase the potential for metal to penetrate into any small gaps at the transition plate to graphite casting ring interface or into any type of excess gas venting scheme. Metal attachments can result in scrapped billet and potential bleed-outs. The temperature of the casting surface increases momentarily during the gas release from the pocket collapse that can lead to increased burning of the casting lubricant and potentially generate varnish, which is another potential aluminum attachment point resulting in surface defects.

In addition to the above issues, casting gas bubbling up through the thimble 130 entrains oxide films in the melt as the oxygen in the casting gas bubble is stripped and reacts with the molten aluminum to form these oxide films. The quality of the billet is diminished by these oxides and surface issues resulting from casting gas movement. It is desirable to eliminate casting gas bubbling up through the melt during the entire casting process to prevent the formation of inclusions. According to example embodiments described herein, embodiments reduce or eliminate casting gas bubbling up through the thimble 130 and through the molten metal to prevent oxide film entrainment. Eliminating any bubbling is a balancing act between allowing enough flow rate of casting gas applied to the mold to maintain an air gap 220 casting condition and restricting the flow rate that escaping gas travels downward along the air gap interface and out through the lower portion of the mold rather than up through the molten metal delivery system. The correct amount of casting gas is directly related to the thermal conditions at the casting surface. Colder casting conditions generally require higher casting gas flow rates than hotter casting conditions due to colder conditions causing the solidification of the billet to occur higher on the casting surface and much of the casting gas escapes out of the bottom of the mold.

Hotter casting conditions move the solidification front further down the casting surface allowing the casting gas to be more effective in maintaining the air gap 220. These conditions also reduce the ability of the gas to be able to escape out of the bottom of the mold, thereby bubbling up through the thimble 130. This situation creates a challenge in that many casting operations pass through a significantly varying metal temperature range from the beginning of the cast through the end of the cast, thereby making it more difficult to optimize the casting gas flow rate to maintain the air gap 220 with minimal rocking of the melt and no bubbling through the thimble 130. However, even when melt temperatures are stabilized, the casting gas flow rate window remains relatively narrow to maintain the highest billet surface quality without losing the air gap 220, generating surge laps, or bubbling. Losing the air gap 220 creates an inferior quality billet as compared to a billet with surge laps, and may result in scrapping of the entire billet. Further, losing the air gap for any period of time may overheat the casting surface and burn the casting oil, plugging the pores of the graphite casting surface 210 thereby preventing gas flow, and requiring mold removal and replacement of the graphite casting ring.

Embodiments described herein include the ability to widen the window of casting gas flow rate without creating any bubbling issues as described above which increases the robustness of the casting. Venting of excess casting gas as described herein enables operating with higher casting gas flow rates that ensures maintaining the air gap 220 at cold casting conditions while not allowing bubbling during hotter conditions.

According to an example embodiment described herein and illustrated in FIG. 7, a cross section of a portion of a transition plate 200 is depicted and described herein. The transition plate of the illustrated embodiment includes a top surface 238 and a bottom surface 248. The transition plate 200 further includes a rim 242 extending around a circumference of the transition plate, where the rim of the illustrated embodiment includes a lip 244. When the transition plate 200 is in position in a casting mold 105, the lip 244 seals the top of the casting cavity against the mold. The lip 244 of the example embodiment is shown elevated relative to the bottom surface 248 of the transition plate 200. The elevated position of the lip 244 relative to the bottom surface 248 of the transition plate 200 produces the casting gas pocket 230. The lip 244 is joined to the bottom surface 248 of the transition plate by a gas pocket surface. The gas pocket surface (240) of the illustrated embodiment of FIG. 7 is a ramp or chamfer, though embodiments include a fillet or radiused surface.

As shown, the transition plate 200 includes a vent hole 250 of a plurality of vent holes around the circumference of the transition plate in the region of the pocket 230. The holes, an example embodiment of which are 0.5 millimeters in diameter, are positioned along a ramp of the gas pocket surface 240 of the gas pocket 230 recess in the transition plate. The vent holes 250 vent to a vent channel 260 to allow casting gas to escape from the casting mold 105. When the gas pocket bubble grows due to the high gas flow rate, the edge of the bubble moves the meniscus 245 down the ramped surface of the pocket along the direction of arrow 255 preparing to breech the pocket edge and bubble up through the melt. However, when the leading edge of the enlarging bubble in the pocket 230 reaches the vent hole 250 on the ramp of the gas pocket surface 240, the gas pocket self-vents the excess gas. This type of system includes orifices through which the gas escapes that are small enough that the metal will not be able to penetrate the orifice due to the surface tension of the molten metal.

In another example embodiment, a vent hole 250 and/or a vent channel 260 are filled with a porous material that can be penetrated by gas, but not by molten metal. Such material includes a fibrous web of material similar to a filter cartridge. The vent hole 250 of an example embodiment is filled with a porous material that provides a particular degree of resistance to gas flow such that the vent hole is optionally positioned in a variety of locations in the pocket 230, such that when the gas pressure in the pocket reaches a sufficient pressure, gas is leaked through the vent hole without requiring a particular position of the gas bubble to breech before venting.

While passive venting is employed as described in the embodiments above, active venting of the gap of an example embodiment provides an alternative system that is configurable by a user. An example embodiment of such active ventilation includes a floating needle valve and seat arrangement that has been designed to crack open at a specific gas pressure in the transition plate 200 pocket 230. The pressure of an example embodiment is selected to be a predetermined pressure, which approximately matches the metallostatic head pressure of the metal level above the mold. When the gas bubble in the pocket increases in size and resultant pressure, the needle lifts from its seat and the excess casting gas escapes, thereby preventing gas from bubbling up through the thimble 130. Such a pressure relief valve 265 of an example embodiment is received within channel 260 of the transition plate 200 as shown in FIG. 7. The pressure relief valve 265 of an example is calibrated to a predefined pressure, which is determined to be a pressure below which casting gas does not bubble up through the molten metal, and above which casting gas escapes in an undesirable path. Further, various pressure relieving systems could be used for active ventilation of the gap to allow or prevent flow of gas from the gas pocket 230 during casting. While venting of the casting gas from the gas pocket 230 may be done to atmospheric pressure or ambient pressure of the casting environment, venting of gas from the gas pocket of an example embodiment is also be regulated by means of pressure control to either increase the amount of gas vented by reducing pressure or increasing pressure to keep gas vents clear as necessary While venting of the gas pocket of the aforementioned embodiments is accomplished through vent holes in the gas pocket as described above, embodiments optionally employ gas paths in the transition plate to guide gas as the gas is escaping from the gas pocket along a defined gas path. An embodiment includes sculpting paths in the transition plate 200 and other refractory components such as the thimble 130 to direct gas along a path between the refractory pot shell and the liquid metal such that a true bubble does not actually form that can float up through the thimble 130 creating entrained oxides. Another example embodiment of crafting a path for the gas to escape is to create a chimney that allows the gas to bubble up towards and out of the metal flow into the mold. While oxide films may be generated in this embodiment, they would not become entrained in the cast billet. The concept of venting excess casting gas enables a much wider window for casting gas flow rates for ease of multi-strand operation (multiple billets concurrently) allowing for reduced meniscus pulsing and eliminating bubbling up through the melt.

FIG. 8 is a flowchart of a method for venting casting gas from a direct chill casting mold. As shown, molten metal is supplied to a direct chill casting mold through a transition plate as shown at 310. This molten metal of an example embodiment is provided through a trough (e.g., trough 125) and a thimble (e.g. thimble 130). Casting gas is supplied through a casting surface of the mold as shown at 320. The casting gas is supplied, for example, through casting surface 220 of a graphite casting ring as shown in FIGS. 2-6. Venting of the casting gas is performed from the gas pocket in the transition plate as shown at 330. The transition plate includes a gas pocket that receives the casting gas and as pressure builds, the casting gas is vented through the mechanisms described above.

Blocks of the flowchart support combinations of means for performing the specified functions and combinations of operations for performing the specified functions for performing the specified functions. It will also be understood that one or more blocks of the flowcharts, and combinations of blocks in the flowcharts, can be implemented by various aspects of venting of casting gas from a direct chill casting mold as described above.

In some embodiments, certain ones of the operations above are modified or further amplified. Furthermore, in some embodiments, additional optional operations are included. Modifications, additions, or amplifications to the operations above of an example embodiment are performed in any order and in any combination that facilitates the venting of casting gas as described herein.

In another embodiment a valving system is used to pressurize the venting holes during the metal filling stage of the cast. Metal spilling into the mold can become turbulent which can force liquid metal into the small venting holes or porous media, effectively plugging off the ability to vent the excess casting gas. Applying a positive gas flow thru the venting system helps to mitigate this problem of metal penetration. The valving system switches from positive flow into the mold cavity, to free flow venting of the gas pocket once the mold is filled with metal and the starting block begins to descend into the casting pit. This valving system could be a separately controlled and operated process, or can be incorporated into the existing casting gas supply porting in the mold itself and use varying casting gas pressure to shuttle between applying positive flow to venting the excess gas. This is not only useful to help prevent metal penetration during mold filling, but also to prevent the vents from being plugged when the casting operators are applying a release agent coating to the hot metal face of the transition plate 200 between casts.

Transition Plate Oxide Dam

Additional embodiments of a transition plate include a transition plate 'oxide dam' where, in the case of hot top billet casting, the term 'oxide dam' refers to an undercut recess in the transition plate from the thimble 130 or thimble area toward the mold bore. The use of an oxide dam creates a condition where the majority of oxide on the head of the billet is trapped and unable to break off and roll over into onto the as-cast billet surface. The hot metal face is greatly reduced and as such, the oxide layer is much thinner and easily maintains mobility flowing outward and rolling over the meniscus and onto the as-cast billet surface. This result leaves the surface of the billet very uniform in appearance and prevents random heavy oxide releases or 'patches' from breaking free during the cast and disturbing the appearance of the billet. A narrow hot metal face also helps to eliminate the need to 'hit' the mold hard with a high gas flow rate to break free the heavy oxides that form from the cascading metal during mold filling.

FIG. 9 illustrates two transition plates 200, with the transition plate on the right being conventional and including a pocket 230 around the periphery where the transition plate engages the mold cavity. The transition plate 200 on the left includes the pocket 230 around the periphery, but also includes an undercut 270, not present in surface 280 of the conventional transition plate. The undercut provides an area in which the thimble 130 will sit below the bottom surface of the undercut providing an oxide dam as the oxides atop the molten metal will be retained within the undercut, while clean, molten metal will flow beneath the undercut, past the pocket 230 and transition down the side of the casting.

Applicant has found that an optimum undercut within the transition plate of an example embodiment of around twelve millimeters deep in order to reliably retain the oxide as the metal head heaves gently up and down with the meniscus pulling lightly due to the air gap casting condition. The hot metal face is generally kept to around twelve to twenty millimeters. This distance is a compromise both to help prevent the gas bubble that forms at the meniscus from breaching over the edge of the oxide dam and bubbling up through the thimble opening, and to limit the time the oxide has to 'grow' in thickness and strength before rolling over the meniscus.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A transition plate for engaging a direct chill casting mold comprising:

a top surface;

a bottom surface, wherein the bottom surface defines an upper surface of a mold cavity of the direct chill casting mold, wherein a casting gas pocket is defined at a periphery of the bottom surface by a gas pocket surface where the transition plate meets a wall of the direct chill casting mold; and one or more vent holes defined within the gas pocket surface configured to vent the casting gas pocket.

2. The transition plate of claim 1, further comprising a lip, wherein the lip extends around the periphery of the transition plate and is separated from the bottom surface by the gas pocket surface.

3. The transition plate of claim 2, wherein the lip is elevated with respect to the bottom surface when the transition plate is engaged with the direct chill casting mold, wherein the lip forms an upper surface of the gas pocket, and wherein the one or more vent holes are defined through the gas pocket surface closer to the bottom surface than to the lip.

4. The transition plate of claim 3, wherein in response to a gas bubble forming in the casting gas pocket, the one or more vent holes are configured to permit casting gas to be vented before the casting gas reaches the bottom surface of the transition plate.

5. The transition plate of claim 1, wherein the gas pocket surface comprises a chamfered surface relative to the bottom surface, wherein the one or more vent holes are defined in the chamfered surface.

6. The transition plate of claim 1, wherein the plurality of vent holes are comprise a web of material that is gas permeable and not permeable by molten metal.

7. The transition plate of claim 1, wherein the one or more vent holes are vented to atmospheric pressure.

8. The transition plate of claim 1, wherein the one or more vent holes are associated with a valve, wherein the valve permits the one or more vent holes to be vented to atmospheric pressure in response to pressure in the casting gas pocket satisfying a predetermined value.

9. The transition plate of claim 1, further comprising a lip, wherein the casting gas pocket is defined between the lip and the bottom surface by the gas pocket surface.

10. A method of venting casting gas from a direct chill casting mold comprising:

supplying the direct chill casting mold with molten metal through a transition plate;

supplying a casting gas through a casting surface of the direct chill casting mold; and venting the casting gas from a gas pocket in the transition plate, wherein the casting gas is vented through one or more vent holes defined in a gas pocket surface disposed at a periphery of the transition plate where the transition plate meets a wall of the direct chill casting mold, the gas pocket surface defining the casting gas pocket wherein venting the casting gas from the gas pocket in the transition plate is performed in response to a pressure of the casting gas in the gas pocket reaching a predetermined pressure.

11. The method of claim 10, wherein the predetermined pressure is determined based on a metallostatic head pressure of the molten metal supplied to the direct chill casting mold.

12. The method of claim 10, further comprising:

supplying pressure to the one or more vent holes in the transition plate to prevent molten metal flow through the one or more vent holes; and reducing or removing pressure to the one or more vent holes to allow venting of casting gas.

13. A system for venting a direct chill casting mold comprising:

a direct chill casting mold;

a thimble through which molten metal is supplied to the direct chill casting mold; and a transition plate attached to the direct chill casting mold and into which the thimble is received, wherein the transition plate comprises a gas pocket surface and one or more vents disposed therein, wherein in response to molten metal filling the direct chill casting mold, casting gas is configured to vented through the one or more vents in the transition plate.

14. The system of claim 13, wherein the transition plate comprises:

a top surface;

a bottom surface and wherein the gas pocket surface extends about a periphery of the transition plate, wherein a casting gas pocket is defined at a periphery of the bottom surface by the gas pocket surface.

15. The system of claim 14, wherein the transition plate further comprising a lip, wherein the lip extends around the periphery of the transition plate and is separated from the bottom surface by the gas pocket surface.

16. The system of claim 15, wherein the one or more vent holes are defined in the gas pocket surface.

17. The system of claim 16, wherein the lip is elevated with respect to the bottom surface when the transition plate is positioned on a mold, wherein the casting gas pocket is formed at the periphery of the transition plate by the lip and the gas pocket surface, and wherein the one or more vent holes are disposed closer to the bottom surface than to the lip.

18. The system of claim 17, wherein in response to a casting gas bubble forming in the casting gas pocket, the one or more vent holes are configured to permit the casting gas bubble to be vented before the casting gas bubble reaches the bottom surface of the transition plate.

19. The system of claim 15, wherein the gas pocket surface comprises a chamfered surface relative to the bottom surface, wherein the one or more vent holes are defined in the chamfered surface.

* * * * *